US007387102B2

(12) United States Patent
Henkel

(10) Patent No.: US 7,387,102 B2
(45) Date of Patent: Jun. 17, 2008

(54) CAST PART FOR AN INTERNAL COMBUSTION ENGINE

(75) Inventor: Horst Henkel, Dautphetal-Friedensdorf (DE)

(73) Assignee: Fritz Winter Eisengiesserei GmbH & Co. KG, Stadtallendorf (DE)

( * ) Notice: Subject to any disclaimer, the term of this patent is extended or adjusted under 35 U.S.C. 154(b) by 317 days.

(21) Appl. No.: 10/536,524

(22) PCT Filed: Nov. 25, 2003

(86) PCT No.: PCT/DE03/03901

§ 371 (c)(1),
(2), (4) Date: May 25, 2005

(87) PCT Pub. No.: WO2004/048765

PCT Pub. Date: Jun. 10, 2004

(65) Prior Publication Data

US 2006/0096567 A1 May 11, 2006

(30) Foreign Application Priority Data

Nov. 26, 2002 (DE) ..... 102 55 284
Feb. 6, 2003 (DE) ..... 103 04 971

(51) Int. Cl.
*F01M 1/04* (2006.01)
*F01M 11/02* (2006.01)

(52) U.S. Cl. ..... 123/196 R; 123/41.34; 123/468

(58) Field of Classification Search ..... 123/196 R, 123/196 CP, 196 M, 196 AB, 468, 469, 41.01, 123/41.31, 41.34, 41.35; 29/888.01, 888.06
See application file for complete search history.

(56) References Cited

U.S. PATENT DOCUMENTS

| | | | | | |
|---|---|---|---|---|---|
| 2,966,146 | A | | 12/1960 | Schweitzer et al. | |
| 4,033,312 | A | | 7/1977 | Howe | |
| 4,237,847 | A | | 12/1980 | Baugh et al. | |
| 4,852,534 | A | * | 8/1989 | Amaral | 123/196 R |
| 4,922,863 | A | * | 5/1990 | Adams | 123/184.61 |
| 4,969,263 | A | * | 11/1990 | Adams | 29/888.06 |
| 4,993,380 | A | * | 2/1991 | Hsu | 123/193.2 |
| 5,000,244 | A | | 3/1991 | Osborne | |
| 5,771,776 | A | * | 6/1998 | Itoh | 92/186 |
| 5,947,065 | A | * | 9/1999 | Bing et al. | 123/41.35 |
| 5,979,298 | A | * | 11/1999 | Whitacre | 92/211 |
| 6,076,494 | A | | 6/2000 | Kampichler et al. | |

(Continued)

FOREIGN PATENT DOCUMENTS

AU 610786 5/1991

(Continued)

*Primary Examiner*—Hai H Huynh
(74) *Attorney, Agent, or Firm*—Collard & Roe, P.C.

(57) ABSTRACT

The invention relates to a cast part for an internal combustion engine, said part being a cylinder crankcase, which has at least one guide duct that leads a fluid medium to a required location. Said guide duct is provided in the form of a tube and is embedded inside the part when the latter is cast. The aim of the invention is to reduce the complexity of production and the costs of the cylinder crankcase. To this end, the fluid medium is provided in the form of oil and the at least one guide duct is provided in the form of an oil supply leading to a crankshaft bearing and/or to a camshaft bearing that are to be lubricated or to other required location.

20 Claims, 7 Drawing Sheets

U.S. PATENT DOCUMENTS

Figure 1:
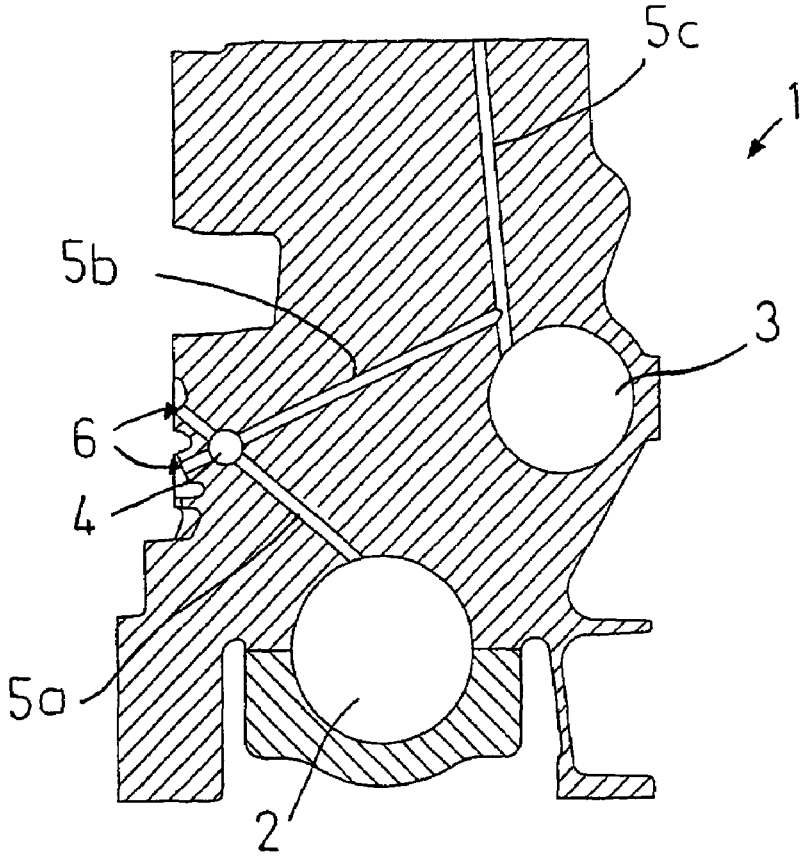

| | | | | |
|---|---|---|---|---|
| 6,158,400 | A | 12/2000 | Collie et al. | |
| 6,237,569 | B1 * | 5/2001 | Stelzer et al. | 123/456 |
| 6,273,050 | B1 * | 8/2001 | Ko | 123/196 R |
| 6,295,963 | B1 | 10/2001 | Kollock et al. | |
| 6,513,480 | B1 * | 2/2003 | Albertson et al. | 123/198 F |
| 7,040,454 | B2 * | 5/2006 | Kawamoto et al. | 184/106 |
| 7,069,885 | B2 * | 7/2006 | Iida | 123/41.82 R |
| 2006/0249104 | A1 * | 11/2006 | Stemmer | 123/41.44 |

FOREIGN PATENT DOCUMENTS

| | | |
|---|---|---|
| DE | 25 01 772 | 7/1976 |
| DE | 30 10 635 | 10/1980 |
| DE | 33 00 924 | 7/1984 |
| DE | 37 23 468 | 1/1989 |
| DE | 43 35 492 | 4/1995 |
| DE | 43 41 040 | 6/1995 |
| DE | 196 52 049 | 7/1998 |
| DE | 198 18 589 | 11/1999 |
| DE | 199 61 092 | 7/2000 |
| DE | 100 15 709 | 12/2001 |
| EP | 0 110 234 | 6/1984 |
| EP | 0 682 574 | 11/1994 |
| EP | 648 927 | 4/1995 |
| EP | 1 116 536 | 7/2001 |
| FR | 2 727 727 | 6/1996 |
| JP | 55-019608 | 9/1981 |
| WO | WO 95/15236 | 6/1995 |
| WO | WO 03/076108 | 9/2003 |

* cited by examiner

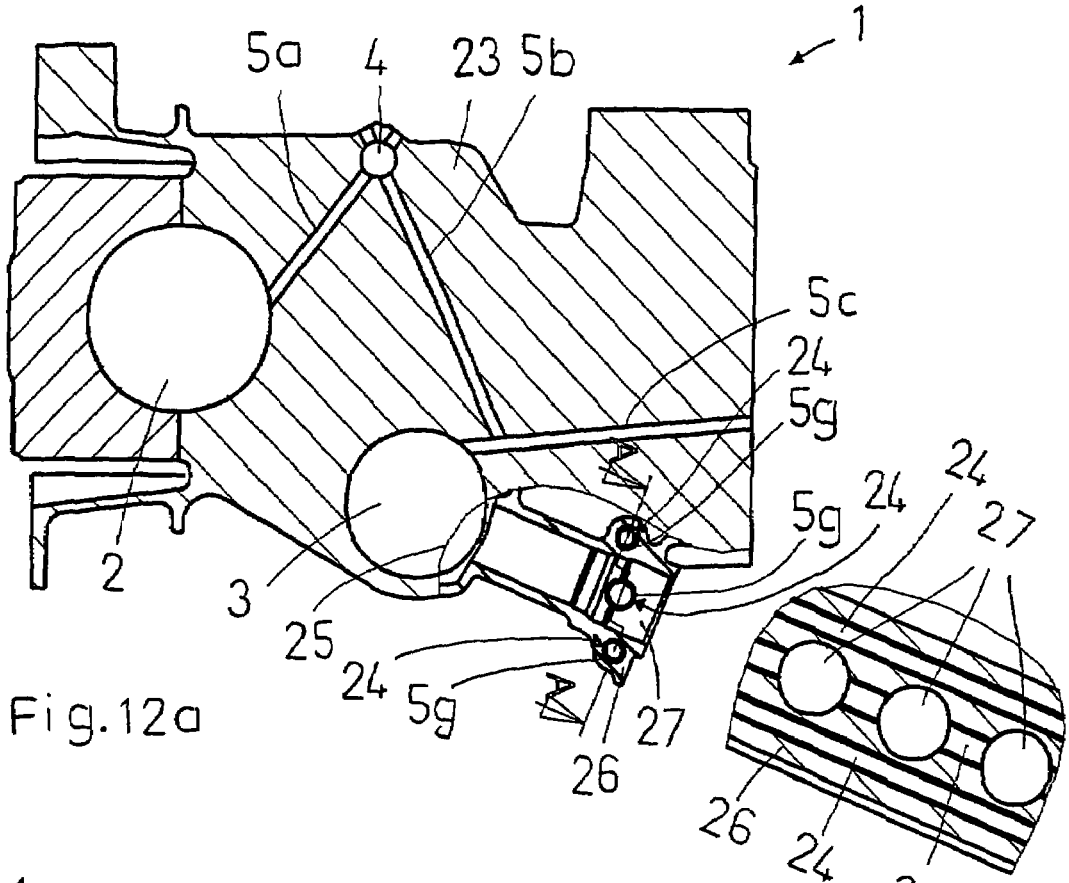
Fig.12a
Fig.12b
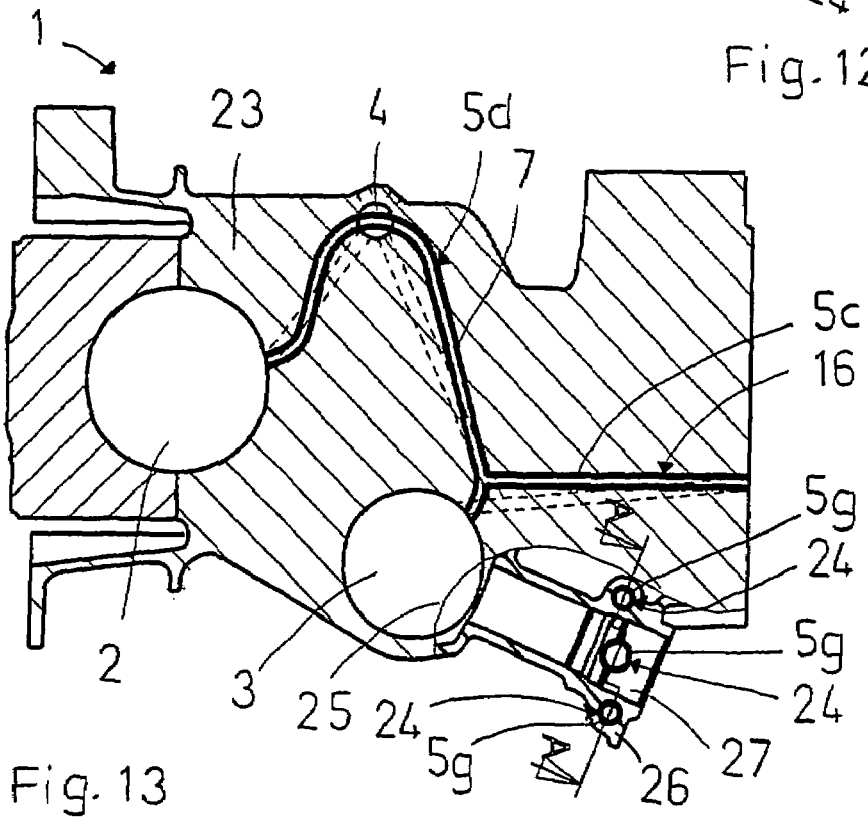
Fig. 13

CAST PART FOR AN INTERNAL COMBUSTION ENGINE

CROSS REFERENCE TO RELATED APPLICATIONS

Applicant claims priority under 35 U.S.C. § 119 of German Application Nos. 102 55 284.3 and 103 04 971.1 filed Nov. 26, 2002 and Feb. 6, 2003, respectively. Applicant also claims priority under 35 U.S.C. § 365 of PCT/DE2003/003901 filed Nov. 25, 2003. The international application under PCT article 21(2) was not published in English.

The present invention relates to a cast part for an internal combustion engine, the part being a cylinder crankcase, which has at least one guide duct that leads a fluid medium to a required location, the duct being implemented in the form of a tube and being embedded inside the part when the latter is cast.

Internal combustion engines are an essential component of vehicles (such as passenger automobiles and utility vehicles, ships, etc.) in the form of internal combustion engines and are also used as stationary engines. In this case, internal combustion engines contain numerous cast components which have at least one guide duct (also referred to as a supply line) that leads a fluid medium (e.g., oil, water, gas, or other liquid and/or gaseous media) to a required location in the engine and/or in adjoining regions. Some of the guide ducts may also be used for cooling a part themselves. Required locations are the points at which the particular medium is necessary, e.g., bearings to be lubricated, regions to be cooled, etc.

A guide duct and/or multiple guide ducts particularly occur in a cylinder crankcase and/or attachments neighboring thereto. Guide ducts are introduced in a known way through mechanical machining on machine tools and/or transfer lines, i.e., drilled. For this purpose, central main guide ducts and secondary guide ducts which form branches to the individual required locations are drilled into the part in multiple complex work steps, which are to be performed with high precision. Subsequently, numerous unnecessary accesses must be closed permanently and securely. Very long, linear guide ducts, such as those of the main oil duct in a cylinder crankcase, are currently even cast individually by casting around a tube or through relief by an appropriate casting core.

Embedding cooling ducts, which are preformed as tubes, having a small diameter in a cast cylinder block and/or cylinder head of an internal combustion engine during manufacturing is known from DE 199 61 092 A1. These lead around components such as spark plugs or fuel injection nozzles and form a cooling system for the liquid cooling of the internal combustion engine. DE 33 00 924 C2 teaches, for water cooling of webs between cylinders of a cylinder block of a water-cooled internal combustion engine, which are cast closely and directly together, embedding tubes in the cast material which forms the webs, these tubes producing a connection between the lateral coolant water mantels of the cylinder block. Intensive cooling of the highly stressed web regions thus results.

The present invention is based on the object of reducing the manufacturing effort and costs in a part—specifically a cylinder crankcase—of the above-mentioned type and suggesting a method for manufacturing a part according to the present invention.

This object is achieved according to the present invention for a cast part of the above-mentioned type by the characterizing features of Claim 1, Claim 14, Claim 17, or Claim 19.

According to the present invention, the cast part is a cylinder crankcase. A cylinder crankcase has numerous guide ducts, particularly for oil and water, so that by embedding a guide duct or multiple guide ducts, which is/are each implemented as a tube, a significant savings in manufacturing effort is achieved. In the case of a single guide duct embedded as a tube, this is not the main oil duct, since this is part of the related art. The object of the present invention is rather, (possibly in addition to embedding the main oil duct as a tube) to embed another guide duct or multiple other guide ducts for oil and/or other media to required locations as tube(s). For example, the oil supply lines to crankshaft and/or camshaft bearings, the supply line for piston cooling, the pressurized oil line to the cylinder head or oil return lines are to be cited as essential guide ducts to required locations in a cylinder crankcase which may advantageously be implemented according to the present invention in the form of embedded tubes.

Furthermore, at least one guide duct which forms a fuel line may be embedded as a tube in the cylinder crankcase.

In the cylinder crankcase according to the present invention according to Claim 1, the at least one guide duct embedded in the cylinder crankcase as a tube is used for the purpose of supplying a bearing located in the cylinder crankcase with oil for lubrication, i.e., it forms an oil supply line. The guide duct expediently runs in the region of a separation wall of the cylinder crankcase for this purpose.

In the cylinder crankcase according to the present invention according to Claim 14, at least one guide duct is embedded as a tube, which forms an oil supply line for supplying the piston cooling and/or lubrication of the cylinder wall. To save labor effort, it is advantageous if multiple pistons and/or cylinders may be supplied from a shared oil supply line. For this purpose, the oil supply line may expediently be implemented and positioned in such a way that it runs in the longitudinal extension of the cylinder crankcase and multiple spray nozzles branch from it, which each spray oil directed into a cylinder chamber below a piston floor, through which the piston floor is cooled and, in addition, the affected cylinder wall is lubricated. Of course, multiple oil supply lines to one cylinder or to multiple cylinders, possibly having other courses, may also be embedded.

In the cylinder crankcase according to the present invention according to Claim 17, at least one guide duct is embedded as a tube which forms an oil supply line for the oil supply of the cylinder head and/or the cylinder heads. The oil supply line may be fed with oil directly from the main oil duct or from a downstream region of the oil economy within the cylinder crankcase.

In the cylinder crankcase according to the present invention according to Claim 19, at least one guide duct is embedded as a tube which forms a fuel line for supplying a fuel pump. The fuel line advantageously runs in the longitudinal extension of the cylinder crankcase in the region of a crankcase external wall. In an advantageous refinement, multiple fuel lines are embedded as tubes, e.g., at least one feed line and at least one return line.

Embedding a pre-manufactured tube as a guide duct has the advantage over mechanical introduction through drilling that the guide duct does not have to run linearly (as with drilling), but rather may be tailored to the required contour course of the part having the particular desired bends. In contrast to this, with linear drilling of a guide duct according to the related art, manufacturing paths which are not useful for supplying the required locations must automatically be employed. Furthermore, a hole has an access to the outside, which must subsequently be closed again, which may lead to sealing problems. The disadvantages and problems of this type do not occur with a guide duct embedded in the form of an appropriately pre-manufactured and/or shaped tube.

A further advantage of the present invention is that an embedded tube guide duct and/or multiple embedded tube guide ducts provide a very high degree of cleanliness on the internal duct wall and the cavity, in contrast to the related art, is free of residues as a result of mechanical introduction of the duct and/or free of casting residues (e.g., core residues) as a result of embedding the duct in the component as a cavity by inserting a core.

This aspect is especially important in a guide duct for bearing lubrication, since residues possibly remaining in the duct reach the bearing with the oil during engine operation and would result in destruction of the bearing.

In addition, it is possible, in contrast to a drilled guide duct, in which only circular cross sections may be implemented, to introduce the duct with nearly any desired cross-sectional shape and thus optimize the course and the supply. Furthermore, through suitable selection of the cross-sectional shape, the thickness of the part wall in which the guide duct is embedded may also be reduced, which results in a weight reduction of the part.

Of course, it is possible to provide one or more guide ducts embedded as a tube according to the present invention and one or more guide ducts introduced in typical ways on the same part.

In an advantageous refinement of the present invention, the at least one guide duct embedded as a tube is positioned in such a way that it runs partially or entirely exposed in some sections, i.e., it may run outside the part wall on its outside and/or inside. The guide duct may, in contrast, be locally enclosed with casting material of the part, like a "shell", in order to ensure the permanent bond of duct and part. The guide duct may (in relation to its longitudinal extension) run completely exposed or, however, be partially embedded in the part wall. The measure of the sectionally exposed course offers the advantage in relation to the related art, in which the guide ducts that are drilled in or embedded using cores may only run in the wall of the part, that the wall thickness of the part may be significantly reduced and material and weight may thus be saved.

According to an advantageous refinement of the present invention, the at least one embedded guide duct has different cross-sectional shapes in its course. In this way, good adaptation to the particular construction of the part is achieved. For example, narrow contoured regions may be overcome. The particular cross-sectional shapes to be implemented depend on the particular construction of the part. Different cross-sectional shapes may be implemented on a tube before the embedding, e.g., through hydroforming of the tube.

According to an advantageous embodiment of the present invention, the part is cast from a metallic material or plastic. The at least one embedded guide duct may also advantageously be manufactured from a metallic material or plastic. For example, steel, all cast iron materials, light metals, and nonferrous heavy metals come into consideration as metallic materials. The specific material which is preferably to be used is also a function of, among other things, the particular part to be cast.

Depending on the cast cylinder crankcase, it may be expedient to provide only one single guide duct embedded as a tube in the part. The part advantageously comprises multiple embedded guide ducts in order to save manufacturing effort and costs. In an advantageous variation, the guide ducts may each be introduced as a single connection tube for the medium guiding. I.e., multiple individual appropriately shaped tubes are also embedded as connecting parts during casting. This offers a high degree of freedom in regard to the course of the guide ducts. According to a further alternative advantageous variation, the embedded guide ducts are implemented by a branched tube system. For this purpose, multiple tubes are connected to one another to form a tube system (e.g., welded) before the casting and subsequently the tube composite is also embedded. A combination of guide ducts in tube composite form and individual connection parts on the same part is also possible and advantageous.

Of course, embedded tubes implemented and positioned according to the present invention may also be implemented as guide ducts in an attachment of a cylinder crankcase—particularly in a cylinder head, a gear case, a chain case, an oil pan, or the like. In this case, guide ducts in the cylinder crankcase and/or in the attachment(s) may be supplied by a shared supply loop or multiple supply loops.

The above-mentioned object is also achieved by a method for manufacturing a cast part for an internal combustion engine, the part being a cylinder crankcase, which has at least one guide duct that guides a fluid medium to a required location, a tube having the desired course being installed in a casting mold required for casting or introduced into a casting core or incorporated into a lost model and/or into its mold medium cavity filler to form the at least one guide duct and subsequently the part being cast using the particular casting method to be employed.

According to the present invention, the tube may also be introduced into multiple casting cores which may be assembled as individual cores into a core block.

According to this casting concept it is possible to manufacture a part having at least one embedded tube guide duct—preferably a cylinder crankcase (but other parts may also be advantageously implemented as attachments for the cylinder crankcase (e.g., cylinder head, gear case, chain case, oil pan, etc.). Depending on whether the at least one guide duct is to be completely embedded in the part wall or is to be; partially or completely exposed, the tube to be embedded is installed in the casting mold (possibly using supports) and/or introduced into the casting core (e.g., inserted into a sand core or also incorporated during the core manufacturing) or incorporated into a lost model and/or directly embedded in its mold medium cavity filler, or the tube is mounted on one tube end in the casting core. When introducing a tube into the casting core, specific regions are to be exposed again in order to produce a solid cast connection to the part. After the casting using the particular casting method to be employed, the cast rough part is removed from the mold, cores and/or loose form medium are removed, and the typical finishing measures are performed.

A cast part according to the present invention may be manufactured using different casting methods. According to a first advantageous method variation, the part is cast in a casting method using a lost mold, e.g., in a pure core mold method, a core mold in combination with green-sand mold method, a core mold in combination with cold resin mold method, etc. According to a second advantageous method variation, the part is cast in a casting method using a permanent mold, e.g., chill casting, die casting, injection molding, etc. In a third preferred variation, the part is cast in the lost foam method. Advantages of the lost foam casting method (a form of full mold casting) are, for example, the lack of core residues on the cast part, the high surface quality, high-quality contour sharpness, and great imaging precision and therefore a relatively low finishing effort.

If the part is to have multiple embedded guide ducts, the tubes necessary for this purpose may preferably be introduced as individual connection tubes. It may also be advantageous to connect multiple tubes into a corresponding tube system, to position the pre-manufactured tube system in the casting mold, core, etc., and subsequently to embed it. Furthermore, it may be advantageous in some variations to connect multiple tubes into a partial tube system and to embed multiple partial tube systems in the part. Which variation is to be preferred is a function of the particular concrete task.

Exemplary embodiments of cylinder crankcases according to the present invention are schematically illustrated in the drawing.

Figure 3:
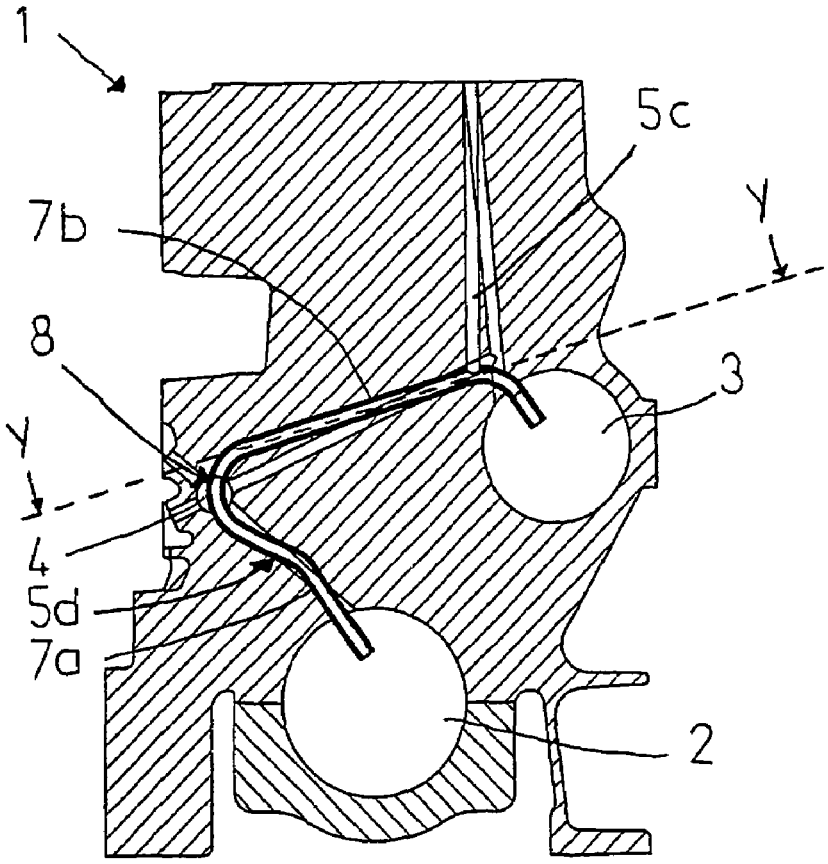
Figure 2:
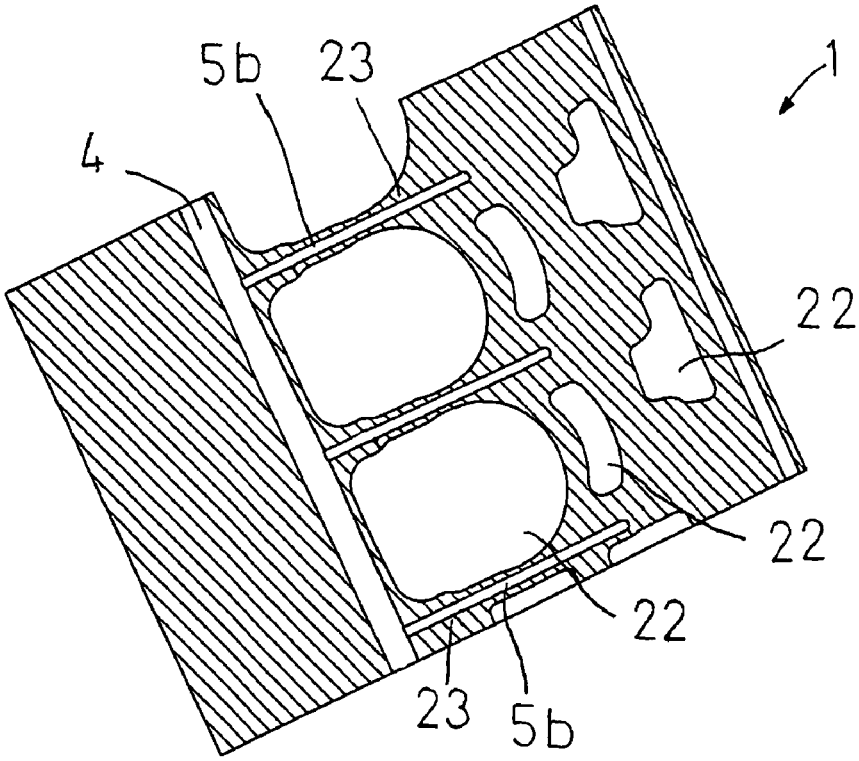
Figure 4:
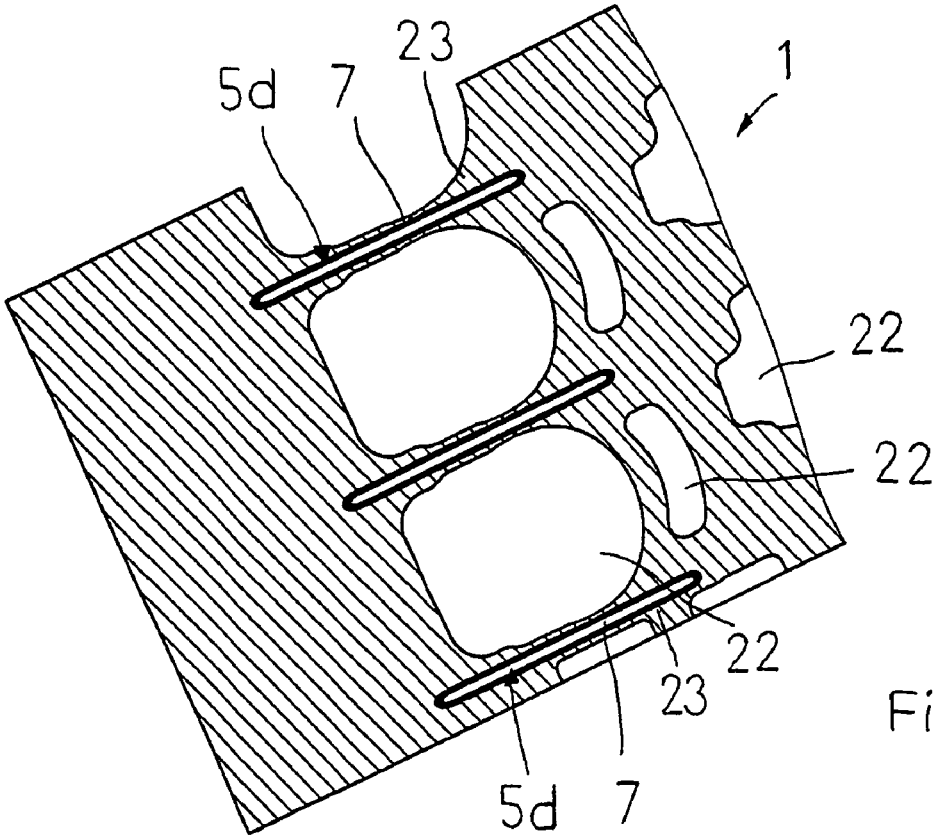
Figure 5:
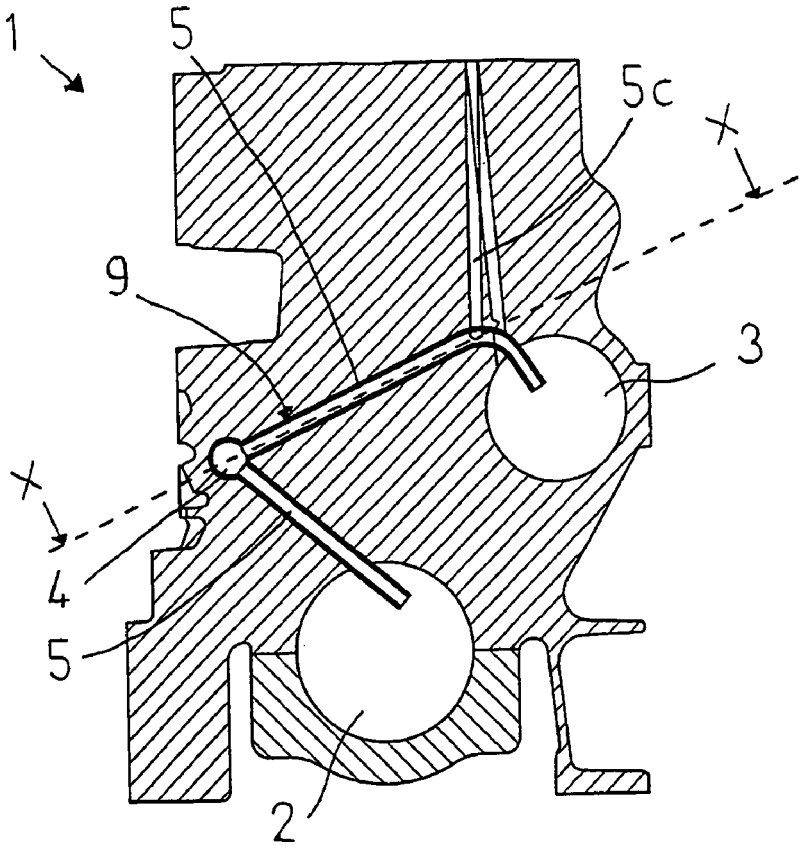
Figure 6:
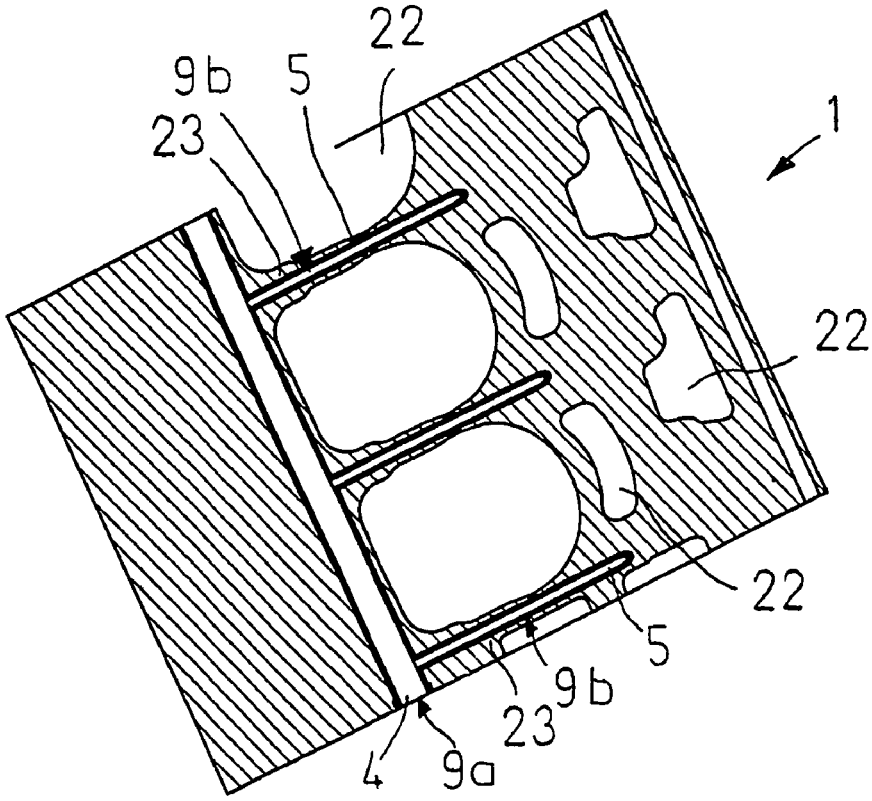
Figure 7:
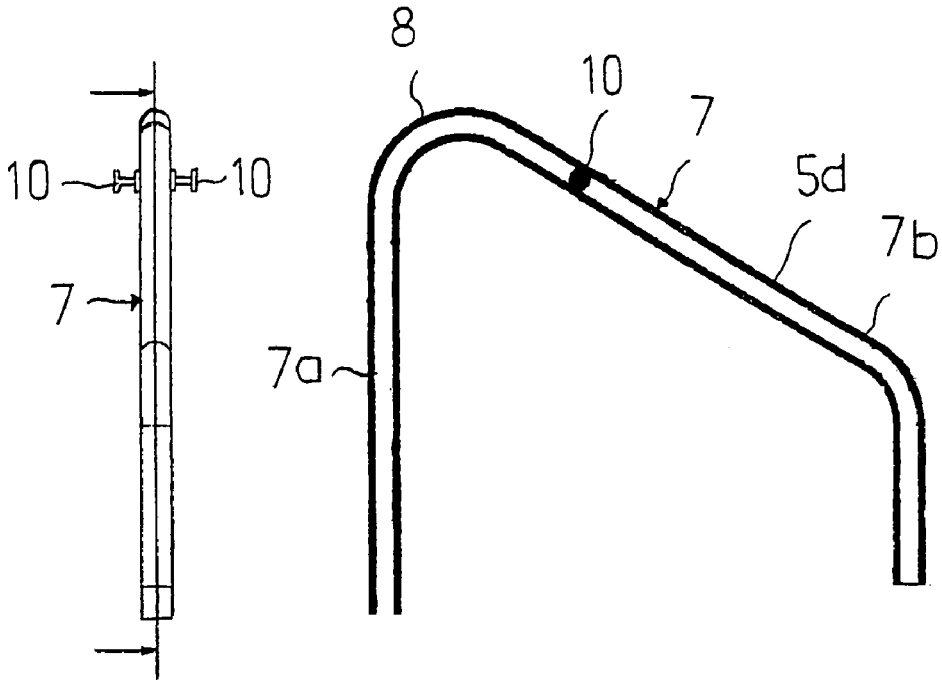
Figure 8:
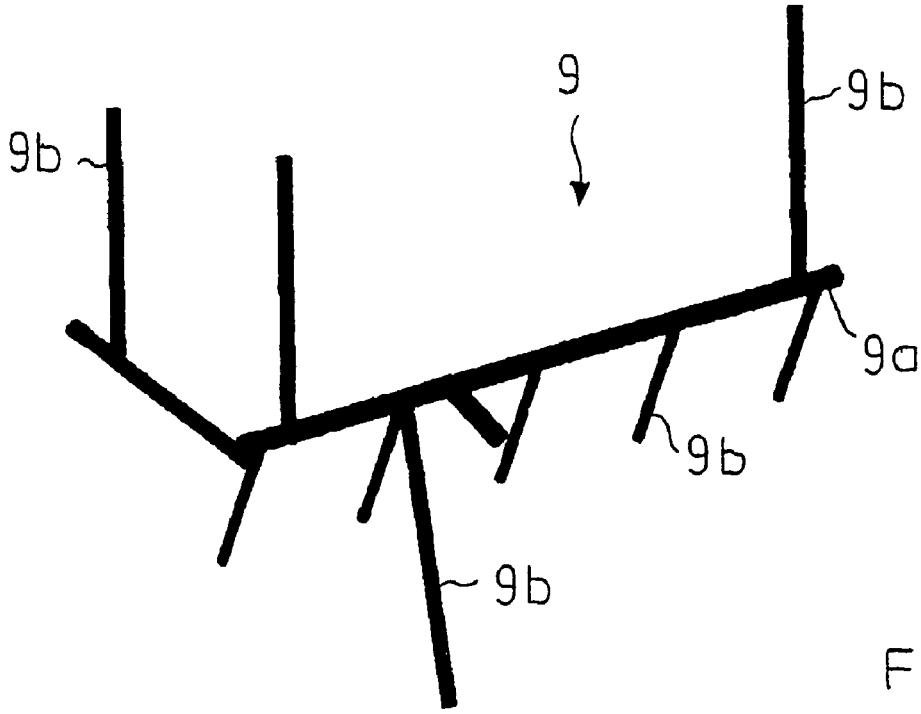
Figure 9:
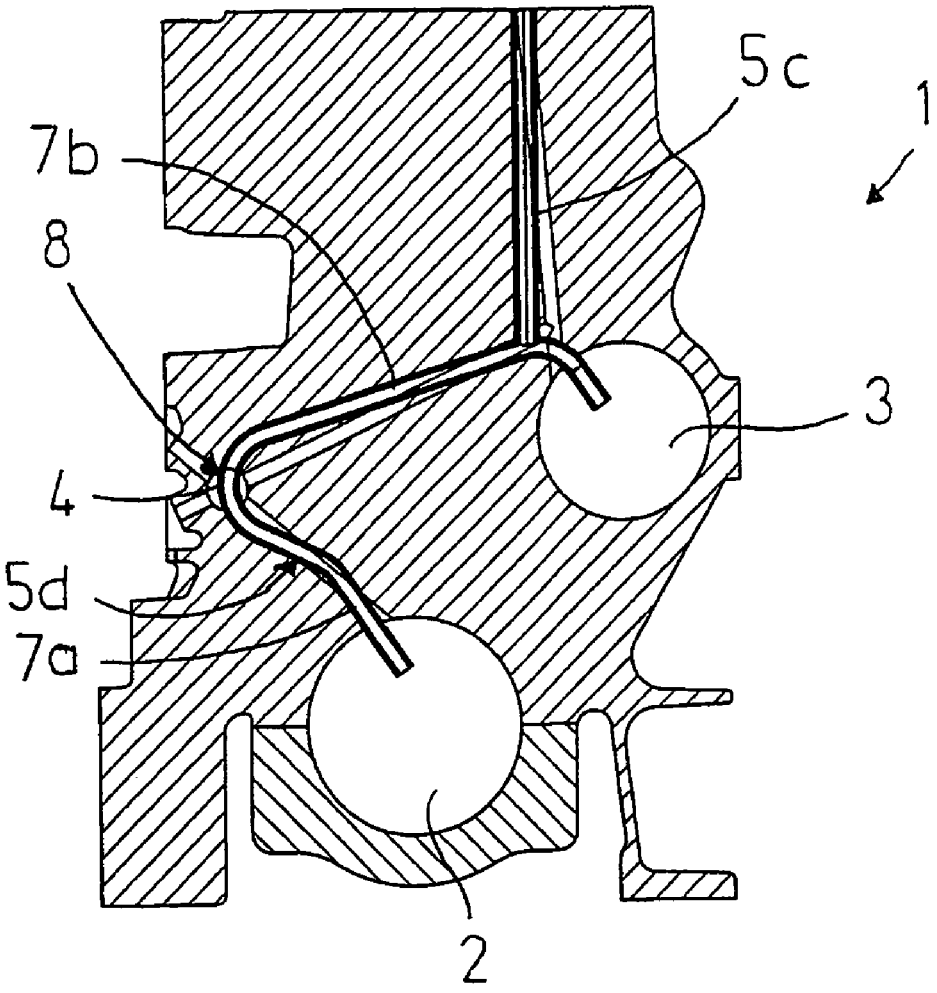
Figure 10:
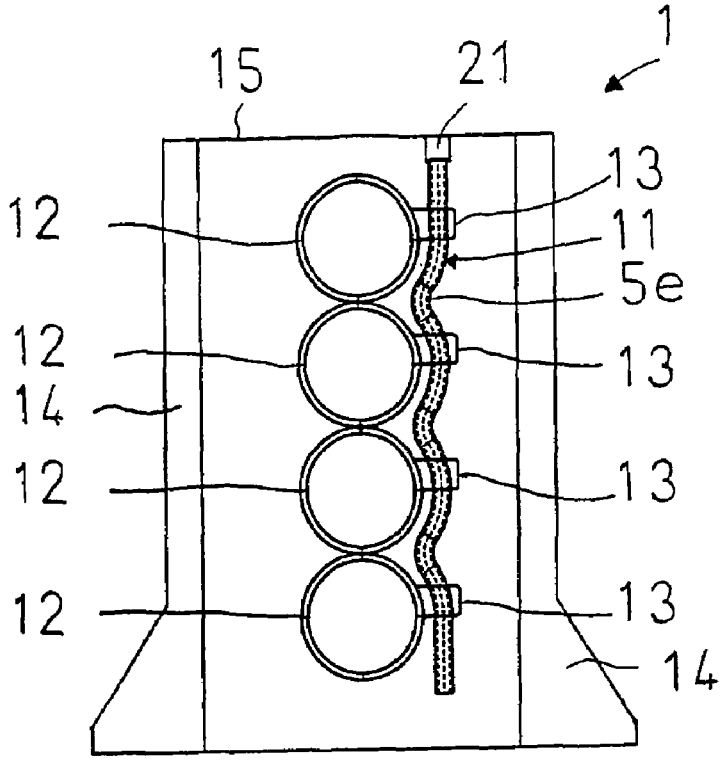
Figure 11:
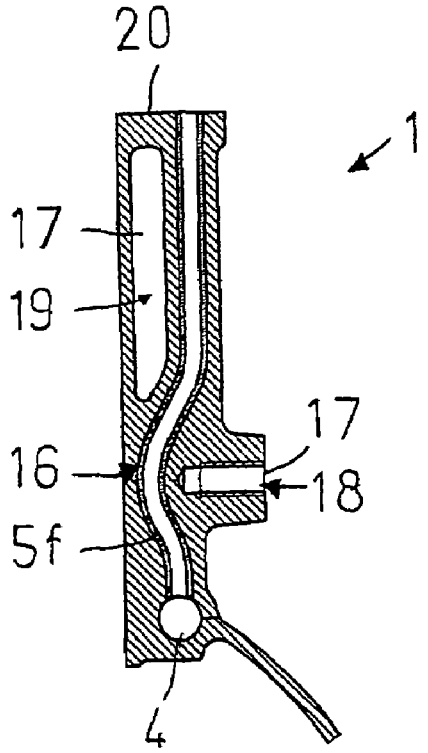

FIG. 1 shows a detail of a cross-section of a cylinder crankcase according to the related art, FIG. 2 shows a detail of a longitudinal section from FIG. 1 (related art), FIG. 3 shows a detail of a cross-section of a cylinder crankcase according to a first exemplary embodiment of a first cylinder crankcase type according to the present invention, FIG. 4 shows a longitudinal section from FIG. 3 corresponding to Y-Y, FIG. 5 shows a detail of a cross-section of a cylinder crankcase according to a second exemplary embodiment of the first cylinder crankcase type according to the present invention, FIG. 6 shows a longitudinal section from FIG. 5 corresponding to X-X, FIG. 7 shows a single connection tube as a guide duct to be embedded for a cylinder crankcase, FIG. 8 shows a tube system to be embedded for a cylinder crankcase, FIG. 9 shows a detail of a cross-section of a cylinder crankcase according to a third exemplary embodiment of the first cylinder crankcase type according to the present invention, FIG. 10 shows a second cylinder crankcase type according to the present invention in a schematic view from below, FIG. 11 shows a detail of a cross-section of a third cylinder crankcase type according to the present invention, FIG. 12*a* shows a detail of a cross-section of a fourth cylinder crankcase type according to the present invention, FIG. 12*b* shows a detail of a longitudinal section corresponding to A-A from FIG. 12*a*, and FIG. 13 shows a detail of a cross-section of a further cylinder crankcase according to the present invention.

In the detail of a cast part shown in FIG. 1, a cylinder crankcase 1 here, according to the related art, a crankshaft bearing 2 and a camshaft bearing 3, as well as a main oil duct 4 (a main guide duct) are illustrated in cross-section. Furthermore, guide ducts 5*a*, 5*b* are shown in longitudinal section, which run from the main oil duct 4 to the crankshaft bearing 2 and/or camshaft bearing 3 and ensure the lubrication of camshaft and crankshaft bearings during engine operation. The guide duct 5*c* originating from the camshaft bearing 3 leads to an attachment of the cylinder crankcase 1, in this case to a cylinder head (not shown). The guide ducts 5*a*, 5*b*, 5*c* shown are introduced subsequently into the cast cylinder crankcase 1, i.e., drilled. Therefore, only a linear course of the guide ducts 5 is possible, and the housing 1 has accesses 6 to the outside (shown on the left), which are required by the manufacturing technique and must be closed later.

In FIG. 2, the main oil duct 4 from FIG. 1 is shown in longitudinal section, and multiple guide ducts 5*b* branching therefrom, which lead to bearings 3 for the camshaft, may be seen. Furthermore, openings 22 in the contour region of the cylinder crankcase 1 are shown. Corresponding openings 22 may also be seen in FIGS. 4 and 6.

FIG. 3 shows a cast part according to the present invention for an internal combustion engine, which has at least one guide duct 5 that leads a fluid medium to a required location. This part is a cylinder crankcase 1. In this case, the section position corresponds to that from FIG. 1.

A guide duct 5*d* is shown, which is implemented in the form of a tube and has also been embedded during casting of the cylinder crankcase 1. The single connection tube 7 embedded as the guide duct 5*d* is implemented here as bent, "like a suitcase handle". Of course, a guide duct 5*d* may also have another shape and/or another course than that shown. From a bend 8, in this case a section 7*a* runs to a crankshaft bearing 2, and another section 7*b* runs to a camshaft bearing 3. The bend 8 is located at the point at which the main oil duct 4 will run, which is introduced subsequently through drilling in a typical way in this exemplary embodiment. When the main oil duct 4 is introduced through drilling, the embedded connection tube 7 is drilled through and the connection of the guide duct 5*d* to the main oil duct 4 is thus produced. In engine operation, oil reaches the particular crankshaft bearing 2 and/or camshaft bearing 3 from the main oil duct 4 via the sections 7*a*, 7*b* of the guide duct 5*d* and/or connection tube 7. The ends of the guide duct 5*d* extending into the camshaft bearing 3 and the crankshaft bearing 2 are required by casting technology and are removed in the course of the finishing. The guide duct 5*c* to the cylinder head is introduced through drilling in this exemplary embodiment.

It may be seen in longitudinal section in FIG. 4 that in the first exemplary embodiment shown, multiple individual connection tubes 7 are embedded as guide ducts 5 for the medium guiding, specifically in the separation wall 23. One end of each of the "suitcase-handle-like" connection tubes 7 shown here discharges into a camshaft bearing 3 and (interrupted by the drilled-in main oil duct 4) the other end discharges into a crankshaft bearing 2.

Of course, it is also possible to embed two separate tubes instead of a curved connection tube, for example, of which one discharges into a crankshaft bearing and the other into a camshaft bearing. Furthermore, it is also possible to supply only one or multiple camshaft bearings with oil via one tube guide duct or multiple tube guide ducts and supply the crankshaft bearings in a typical way through mechanically introduced ducts. Correspondingly, one or more crankshaft bearings may be supplied with oil via one tube guide duct or multiple tube guide ducts and the camshaft bearings may be supplied in a typical way through mechanically introduced ducts.

In the second exemplary embodiment shown in FIGS. 5 and 6, the main oil duct 4 and the guide ducts 5 to the camshaft bearings 3 and crankshaft bearings 2 are implemented as embedded tubes, and this is implemented through a branched, embedded tube system 9. For this purpose, tubes having appropriate dimensions (length, diameter, cross-sectional shape, etc.) are connected before the casting into a tube system 9, which has subsequently been embedded in a suitable casting method.

It is not shown in FIGS. 3 through 6 that the guide ducts 5 embedded according to the present invention as tubes do not have to be completely enclosed by cast material, i.e., run in the part wall, but rather may also run exposed in some sections. Furthermore, the guide ducts 5 may also have a bent course tailored to the contour course.

FIG. 7 shows a connection tube 7 for a "suitcase-handle-like" guide duct 5*d* in different views. The core supports 10 shown are used for lateral support during the casting process. However, it is also possible to manage without core supports 10 if, for example, the ends of the connection tube 7 have been anchored sufficiently strongly in casting cores.

FIG. 8 shows an example of a tube system 9 according to the present invention. Multiple secondary guide ducts 9*b*, which lead to the individual required locations and supply them with the appropriate medium, branch off from a main guide duct 9*a*.

In the third exemplary embodiment of a cylinder crankcase 1 illustrated in FIG. 9, multiple individual "suitcase-handle-like" connection tubes 7 are—corresponding to the first exemplary embodiment from FIGS. 3 and 4—embedded as guide ducts 5*d* during casting of the crankcase. In this case, the crankshaft bearing 2 and the camshaft bearing 3 are supplied with a lubricant from the main oil duct 4, which is introduced subsequently through drilling and intersects each of the connection tubes 7, via the sections 7*a*, 7*b*. In contrast to the first exemplary embodiment, here the guide ducts 5*c* to the cylinder heads are not drilled subsequently into the cylinder crankcase 1, but rather are also implemented in the form of tubes embedded during casting of the crankcase, through which an additional finishing step on the cast part is advantageously saved. A connection tube 7 and a tube for implementing the guide duct 5*c* are each connected to one another for this purpose before the casting.

Of course, a guide duct 5*c* to the cylinder head may also branch off from a connection tube 7 at a different location than that shown. It is also possible for a guide duct 5*c* not to be supplied with lubricant via a connection tube 7, but rather directly from the drilled main oil duct 4 (e.g., by embedding separate, appropriately positioned tubes to implement guide ducts 5*c* for supplying the cylinder heads). Furthermore, the guide ducts 5*c*, which lead to the cylinder heads and are implemented as embedded tubes, may also be part of an embedded tube system (corresponding to the second exemplary embodiment shown in FIGS. 5 and 6) and branch off either directly from the tubular main oil duct 4 or from secondary guide ducts 9*b*. In addition, a tubular guide duct 5*c* may not branch off from the main oil duct 4, a connection tube 7, a secondary guide duct 9*b*, etc., but rather discharge in the region of a bearing (here, for example, the camshaft bearing 3, but other bearings are also possible) into a groove of a bearing ring and be supplied with lubricant from there.

FIG. 10 shows a further cylinder crankcase 1 according to the present invention as a cast part for an internal combustion engine. Oil pan connection surfaces 14, to which an oil pan is attachable, may be seen laterally. The cylinder crankcase 1 has at least one guide duct 5*e*, which leads a fluid medium to a required location, is implemented in the form of a tube, and is embedded during casting of the cylinder crankcase 1. In the cylinder crankcase 1 according to the present invention shown here, the guide duct 5*e* embedded as a tube forms an oil supply line 11 for piston cooling, i.e., conducts oil as the fluid medium to a required location. The oil supply line 11 ends here above a depression 21 on a face 15 of the cylinder crankcase 1 and is supplied with oil from an oil pump. Of course, lubricant may also be fed into the oil supply line 11 at another location of the oil loop within the cylinder crankcase 1.

In the exemplary embodiment shown, multiple cylinders 12 are advantageously supplied from a shared oil supply line 11. For this purpose, the embedded tube guide duct 5*e* is positioned in the longitudinal extension of the cylinder crankcase 1, i.e., transversely to the cylinders 12. It runs here in the region of the crank chambers on the lower cylinder regions at a certain distance to the cylinder external walls. It may be seen that the guide duct 5*e* is tailored to the form of the cylinder 12, so that a "wavy" curved shape results. The oil supply line 11 is implemented as essentially exposed in the exemplary embodiment. It is locally enclosed with cast material of the part, like a "shell", at multiple locations. These cast supports 13 produce a solid bond of oil supply line 11 and part. The cast supports 13 also form the mounting points for the spray nozzles (not shown). The spray nozzles are subsequently mechanically introduced into the oil supply line 11 and are each implemented and positioned in such a way that they spray lubricant directed into a cylinder chamber below a piston floor. The pistons are thus cooled and, in addition, the cylinder walls are lubricated.

Through the curved, tailored course of the oil supply line 11 for the piston cooling and through its predominantly exposed implementation, which is only locally enclosed by cast material, a significant reduction in weight of the part and savings in mechanical machining effort is achieved in relation to the known oil supply lines, which are drilled linearly into cast material.

Of course, the oil supply line 11 may also have another course and/or another position or even be completely enclosed over the entire length or larger regions. Furthermore, multiple guide ducts 5*e*, which form oil supply lines 11 for piston cooling, may also be embedded. If necessary, the oil supply line 11 may also advantageously have different cross-sectional shapes in its course.

FIG. 11 shows another cylinder crankcase 1 according to the present invention as a cast part for an internal combustion engine, which has at least one guide duct 5*f*, which leads a fluid medium to a required location, is implemented in the form of a tube, and is embedded during casting of the cylinder crankcase 1. In the cylinder crankcase 1 according to the present invention shown here, the guide duct 5*f*, which is embedded as a tube, forms a pressurized oil line 16 to a cylinder head.

The pressurized oil line 16, embedded as a tube, is directly supplied with lubricant from a main oil duct 4 here. In the exemplary embodiment shown, the connection of the guide duct 5*f* to the oil loop is produced through the subsequent drilling of the main oil duct 4. Alternatively, the pressurized oil line 16 may also be fed from another region of the oil economy within the cylinder crankcase 1, in that it has been connected to another oil-guiding line to form a tube composite before being embedded in the cylinder crankcase, for example, (cf. FIG. 9) or in that it discharges into a groove of a bearing. Numerous further advantageous variations are possible.

Because of an obstruction 17—in the exemplary embodiment shown, a threaded hole 18 and another opening 19 are illustrated as examples—the guide duct 5*f* embedded as a tube has a course tailored to the contour course and is bent "like a curve" here. Obviously, other course shapes are also possible as a function of constructive conditions. The pressurized oil line 16 is completely enclosed by cast material in longitudinal extension here. Alternatively, depending on the constructive conditions, it may also be advantageously positioned in such a way that it runs partially or completely exposed in some sections. Furthermore, it may advantageously have different cross-sectional shapes in its course in order to overcome narrow points in the cylinder crankcase 1, for example.

The pressurized oil line 16 to the cylinder head, which is embedded in the cylinder crankcase 1, ends at a cylinder head connection surface 20. The expedient number of pressurized oil lines 16 embedded as tubes for supplying oil to the cylinder head and/or the cylinder heads via the cylinder crankcase 1 is a function of the particular equipment of the engine.

The implementation of the cylinder head oil supply in the form of an embedded tube and/or multiple embedded tubes is very advantageous for the designer, since he does not have to introduce his oil duct linearly—as in the case of mechanical introduction by drilling—but rather may introduce it curved and therefore tailored to the spatial conditions.

FIGS. 12*a* and 12*b* show yet another cylinder crankcase 1 according to the present invention as a cast part for an internal combustion engine, which has at least one guide duct 5*g*, which leads a fluid medium to a required location, is implemented in the form of a tube, and is embedded during casting of the cylinder crankcase 1. In the cylinder crankcase 1 according to the present invention shown here, the guide duct 5*g* embedded as a tube forms a fuel line 24 for supplying a fuel pump with fuel as the fluid medium. The curved line 25 in FIG. 12*a* indicates that the illustration of the embedded fuel line 24 lies in a different sectional plane than the rest of the drawing.

It may be seen that multiple guide ducts 5*g* are advantageously each embedded as a tube in an external wall 26 of the cylinder crankcase 1, and they run in the longitudinal extension of the cylinder crankcase 1 (cf. FIG. 12*b*). In this case, the central fuel line 24 in the example shown is a fuel supply line and the external fuel lines 24 are each fuel return lines. Of course, other numbers of embedded lines and/or other occupations of the lines are possible. Furthermore, an opening 27 is shown in FIG. 12*a*, into which a fuel pump is later inserted. As may be seen in the detail of a longitudinal section in FIG. 12*b*, multiple openings 27 for fuel pumps are provided over the length of the central fuel line 24, the number being a function of the cylinder count of the particular engine.

In the course of finishing measures on the cast part, the fuel supply line is cut and/or cut through in the regions of each of the openings 27 for the fuel pumps and the connections between guide duct 5*g* and pumps are thus produced. Openings in the fuel return lines are also later introduced mechanically. Fuel is taken from the supply line by each fuel pump and pumped to a spray nozzle in the cylinder head through a connection line.

According to the related art, fuel lines are mechanically introduced into the external wall of a cylinder crankcase as long, linear holes. Embedding one or more fuel line(s) as tubes using the manufacturing method according to the present invention offers the advantageous possibility that the guide duct may be curved if necessary. It may advantageously run exposed, predominantly or in sections, may even have non-round cross-sectional shapes, or may have different cross-sectional shapes in its course. Thus, for example, a reduction of the part wall thicknesses is possible, which results in savings in material and weight as well as reduced manufacturing costs. Furthermore, the course of the lines may be optimized. Since the fuel line(s) 24 is/are already provided integrated in the finished cast part, the work effort is additionally significantly reduced overall.

It may be seen in the exemplary embodiment of a cylinder crankcase 1 according to the present invention shown in FIGS. 12*a* and 12*b* that here only the fuel lines 24 are embedded as tubes in the crankcase. The guide ducts 5*a*, 5*b*, which run in a separation wall 23, for supplying camshaft bearing 3 and crankshaft bearing 2 with oil, as well as a supply duct 5*c* to the cylinder head, are subsequently introduced mechanically through drilling here.

The embodiments according to the present invention described above in the form of four cylinder crankcase types according to the present invention—specifically a) oil supply of crankshaft bearing and/or camshaft bearings by at least one guide duct embedded as a tube (cf. FIGS. 3 to 8), b) oil supply for piston cooling by at least one guide duct embedded as a tube (cf. FIG. 10), c) oil supply of the cylinder head and/or the cylinder heads by at least one guide duct embedded as a tube (cf. FIGS. 9, 11), and d) providing a fuel line through at least one guide duct embedded as a tube (cf. FIG. 12)—may advantageously also be implemented in an expedient combination on the same cylinder crankcase.

An example of an advantageous combination of this type is shown in FIG. 13. A cylinder crankcase 1 is shown therein, in which the supply of crankshaft bearings 2 and camshaft bearings 3 with lubricant is implemented by bent guide ducts 5*d* embedded in the separation wall 23 (corresponding to the exemplary embodiment described in FIGS. 3 and 4). In addition, a guide duct 5*c* embedded as a tube is provided here, which forms a pressurized oil line 16 to a cylinder head. Contrary to the exemplary embodiment shown in FIG. 11, this line is not supplied with oil directly from the main oil duct 4, but rather branches off from the embedded guide duct 5*d*. In addition, guide ducts 5*g* embedded as tubes are provided, which form fuel lines 24 (supply line and return lines) for supplying a fuel pump (corresponding to the exemplary embodiment of FIG. 12).

Numerous further combinations may advantageously be implemented and are also included by the present invention, e.g., an embedded bearing supply via separate connection tubes 7 or an embedded tube system 9 in connection with an embedded supply line 11 for piston cooling; an embedded supply line 11 for piston cooling in connection with an embedded fuel line 24; an embedded pressurized oil line 16 to the cylinder head in connection with an embedded fuel line 24, etc.

The guide ducts 5 illustrated in the exemplary embodiments as examples for oil supply and fuel supply may correspondingly also be transferred to guide ducts 5 for another medium.

The present invention was described in this case for a cylinder crankcase 1, the cylinder crankcase able to be implemented in one piece or in multiple pieces and/or the crankcase also able to have a cylinder case placed thereon. Of course, the present invention is not restricted to the cylinder crankcase 1, but rather may also be transferred to one or more attachment(s) for the cylinder crankcase 1—particularly to cylinder heads, gear case, chain case, oil pans—and to other parts manufactured in a casting process.

LIST OF REFERENCE NUMBERS

1 cylinder crankcase
2 crankshaft bearing
3 camshaft bearing
4 main oil duct
5 guide duct (general)
5*a* guide duct

5*b* guide duct
5*c* guide duct
5*d* guide duct
5*e* guide duct
5*f* guide duct
5*g* guide duct
6 access
7 connection tube
7*a* section of 7
7*b* section of 7
8 bend
9 tube system
9*a* main guide duct
9*b* secondary guide duct
10 core support
11 oil supply line for piston cooling
12 cylinder
13 cast support
14 oil pan connection surface
15 face of 1
16 pressurized oil line
17 obstruction
18 threaded hole
19 opening
20 cylinder head connection surface
21 depression
22 opening
23 separation wall
24 fuel line
25 bent line
26 external wall
27 opening for fuel pump

The invention claimed is:

1. A cast part for an internal combustion engine, the part being a cylinder crankcase (1), which has at least one guide duct (5, 5*d*), which leads a fluid medium to a required location, the duct being implemented in the form of a tube and being embedded inside the part when the latter is cast, the fluid medium being oil and the at least one guide duct (5, 5*d*) being an oil supply line to a crankshaft bearing (2) and/or camshaft bearing (3) to be lubricated as the required location, wherein the cylinder crankcase (1) comprises multiple embedded guide ducts (5, 5*d*) which are each introduced as an individual connection tube (7) for guiding the medium, the connection tubes (7) being each bent and each having a bend (8) from which one section (7*a*) runs to a crankshaft bearing (2) and another section (7*b*) runs to a camshaft bearing (3), the bends (8) of the embedded connection tubes (7) each being located at positions at which a main oil duct (4) subsequently introduced through drilling runs, so that by introducing the main oil duct (4), the connection tubes (7) are drilled through and a connection of a connection tube (7) to the main oil duct (4) is thus produced in each case.

2. The cast part according to claim 1, wherein the connection tubes (7) are implemented as tailored to the contour course, advantageously bent "like a suitcase handle".

3. The cast part according to claim 1, wherein the cylinder crankcase (1) comprises at least one guide duct (5*c*) for oil, embedded as a tube, which leads to a cylinder head.

4. The cast part according to claim 3, wherein the at least one guide duct (5*c*) to the cylinder head branches off from an individual connection tube (7).

5. The cast part according to claim 3, wherein the at least one guide duct (5*c*) to the cylinder head is a separately embedded tube which is supplied with oil directly from a drilled main oil duct.

6. The cast part according to claim 1, wherein the cylinder crankcase (1) comprises at least one guide duct (5*e*) embedded as a tube, which forms a supply line (11) for piston cooling.

7. The cast part according to claim 1, wherein the cylinder crankcase (1) comprises at least one guide duct (5*g*) embedded as a tube, which forms a fuel line (24) for supplying a fuel pump.

8. A cast part for an internal combustion engine, the part being a cylinder crankcase (1) which has at least one guide duct (5, 5*e*), which leads a fluid medium to a required location, the duct being implemented in the form of a tube and being embedded inside the part when the latter is cast, wherein the fluid medium is oil and the at least one guide duct (5*e*) embedded as a tube forms a supply line (11) for piston cooling;

wherein the supply line (11) for piston cooling is implemented as essentially exposed and is locally enclosed with cast material of the part, like a "shell", at multiple locations so that cast supports (13) are formed; and wherein the cast supports (13) are mounting points for spray nozzles, which can be subsequently mechanically introduced into the supply line (11) for piston cooling and which are each implemented and positioned in such a way that they spray lubricant directed into a cylinder chamber below a piston floor.

9. The cast part according to claim 8, wherein the supply line (11) for piston cooling is positioned in the longitudinal extension of the cylinder crankcase (1) and multiple cylinders (12) are supplied with oil from a shared supply line (11).

10. The cast part according to claim 8, wherein the cylinder crankcase (1) comprises at least one guide duct (5*f*) embedded as a tube, which forms a pressurized oil line (16) to a cylinder head.

11. The cast part according to claim 8, wherein the cylinder crankcase (1) comprises at least one guide duct (5*g*) embedded as a tube, which forms a fuel line (24) for supplying a fuel pump.

12. A cast part for an internal combustion engine, the part being a cylinder crankcase (1), which has at least one guide duct (5, 5*f*), which leads a fluid medium to a required location, the duct being implemented in the form of a tube and being embedded inside the part when the latter is cast, wherein the fluid medium is oil and the at least one guide duct (5*f*) embedded as a tube forms a pressurized oil line (16) to a cylinder head; and wherein one end of the pressurized oil line (16) is positioned at a position at which the main oil duct (4) subsequently introduced through drilling runs and the other end of the pressurized oil line (16) ends at a cylinder head connection surface (20).

13. The cast part according to claim 12, wherein the pressurized oil line (16) has a bent course tailored to the contour course of the cylinder crankcase (1).

14. The cast part according to claim 12, wherein the cylinder crankcase (1) comprises at least one guide duct (5*g*) embedded as a tube, which forms a fuel line (24) for supplying a fuel pump.

15. A cast part for an internal combustion engine, the part being a cylinder crankcase (1), which has at least one guide duct (5, 5*g*), which leads a fluid medium to a required location, the duct being implemented in the form of a tube and being embedded inside the part when the latter is cast, wherein the fluid medium is fuel and the at least one guide duct (5*g*) embedded as a tube forms a fuel line (24) for supplying a fuel pump;

wherein the fuel line (24) is positioned in the longitudinal extension of the cylinder crankcase (1); and wherein the fuel line (24) is a fuel supply line and wherein multiple openings (27) for fuel pumps are provided in the cylinder crankcase (1) over the length of the fuel supply line, the fuel supply line being cut and/or cut through in the regions of each of the openings (27) for fuel pumps in the course of finishing measures on the cast part and the connections between guide duct (5*g*) and fuel pumps subsequently inserted into the openings (27) for fuel pumps being thus produced.

16. The cast part according to claim 14, further comprising a fuel return line.

17. A method for manufacturing a cast part for an internal combustion engine, the part being a cylinder crankcase (1), which has at least one guide duct (5), which leads a fluid medium to a required location, wherein, to form the at least one guide duct (5), a tube having the desired course is installed in a casting mold required for casting or is introduced into a casting core or is incorporated into a lost model and/or into its form medium cavity filler and subsequently the part is cast using the particular casting method to be employed, wherein multiple guide ducts (5, 5*d*) are embedded inside the cylinder crankcase (1) in the form of individual connection tubes (7) and subsequently a main oil duct (4) is mechanically introduced into the cylinder crankcase (1) through drilling, so that the connection tubes (7) are drilled through and a connection of a connection tube (7) to the main oil duct (4) is thus produced in each case.

18. The method according to claim 17, wherein the part is cast in a casting method using a lost mold.

19. The method according to claim 17, wherein the part is cast in a casting method using a permanent mold.

20. The method according to claim 17, wherein the part is cast in the lost foam method.

* * * * *

UNITED STATES PATENT AND TRADEMARK OFFICE

CERTIFICATE OF CORRECTION

PATENT NO. : 7,387,102 B2
APPLICATION NO. : 10/536524
DATED : June 17, 2008
INVENTOR(S) : Henkel It is certified that error appears in the above-identified patent and that said Letters Patent is hereby corrected as shown below:

In Column 13, line 24, please change "14" to correctly read:

--15--.

Signed and Sealed this

Twelfth Day of August, 2008

JON W. DUDAS
*Director of the United States Patent and Trademark Office*